US012258181B1

(12) United States Patent
Gorcey

(10) Patent No.: US 12,258,181 B1
(45) Date of Patent: Mar. 25, 2025

(54) WINE COVER

(71) Applicant: Adam Gorcey, Eatontown, NJ (US)

(72) Inventor: Adam Gorcey, Eatontown, NJ (US)

( * ) Notice: Subject to any disclaimer, the term of this patent is extended or adjusted under 35 U.S.C. 154(b) by 28 days.

(21) Appl. No.: 18/473,805

(22) Filed: Sep. 25, 2023

(51) Int. Cl.
*B65D 41/22* (2006.01)
*B65D 23/08* (2006.01)

(52) U.S. Cl.
CPC ..... *B65D 41/22* (2013.01); *B65D 23/0871* (2013.01)

(58) Field of Classification Search
CPC ..... B65D 41/22; B65D 41/52; B65D 23/0871
USPC ..... 215/319, 317, 228; 220/287, 730, 212
See application file for complete search history.

(56) References Cited

U.S. PATENT DOCUMENTS 1,675,170 A * 6/1928 Ehmann ..... B65D 51/00 215/271
3,862,614 A * 1/1975 Kovac ..... B65D 41/22 206/820
4,901,881 A * 2/1990 McElroy ..... B65D 51/00 215/229
D401,151 S * 11/1998 Rogge ..... D9/454
2002/0184818 A1* 12/2002 Roskin ..... A47G 7/07 47/41.11
2003/0082320 A1* 5/2003 Toussant ..... B65D 43/02 428/40.1
2011/0204071 A1* 8/2011 Plumlee ..... A47G 19/2211 220/730

* cited by examiner

*Primary Examiner* — Robert J Hicks

(57) ABSTRACT

A cover having a body with a length defined between a top end and a bottom end. The body has a plurality of apertures positioned at the top end permitting air to flow into an interior of the body. An opening in the body is positioned adjacent the bottom end of the body and is sized and shaped to receive a portion of a container therein, such as a wine bottle, a wine glass or a wine decanter. A securement mechanism is positioned adjacent to the opening and is engageable to change a size of the opening from a first size to a second size. Protrusions can be positioned about the body to provide a gripping surface to the cover.

20 Claims, 4 Drawing Sheets

WINE COVER

BACKGROUND

Insects, such as flying insects, can be attracted to food and drinks. Such attraction can not only be frustrating or annoying but also may expose consumers to health risks caused by these insects. As a result, it is common for consumers to discard and dispose of such food and drinks after these insects invade or otherwise make contact with food or drinks.

For example, in the wine industry, discarding an expensive or sentimental bottle, glass or container of wine can be devastating to consumers. Beside just insects, wine enthusiasts often encounter situations where they need to protect their wine glasses, decanters and bottles from other various external factors, such as dust, debris, and exposure to outdoor elements. One specific common annoyance are fruit flies and other flying insects that are attracted to the sugar and yeasts in wine. These insects can often be seen hovering around the surface of the wine or crawling on the glass. Again, these are not only a nuisance, but the flies can actually contaminate the wine with bacteria.

Consumers have attempted various solutions to this problem. For example, one way to address the fruit fly problem is to use a fruit fly trap in the same room as the wine. Such an approach frequently does not work and sometimes even results in more fruit flies being attracted to the area.

As another example, consumers have even tried pouring a layer of olive oil on the surface of the wine. Such approach certainly destroys the appearance of a wine and for many users can be unappealing and result in at least some of the wine having to be discarded. Further, some consumers place a coaster on top of the glass of wine to prevent anything from getting into the wine, including such fruit flies or other insects. However, the problem with a coaster is that it is not properly constructed to allow the wine to breathe. Lacking breathability can lead to condensation and affect the wine's temperature and taste. Furthermore, coasters may not securely attach to the glass, decanter or bottle and leave gaps or apertures where flies or other items may enter. Additionally, these coasters are not usually free of contaminants and can frequently contaminate the wine with dirt, dust or other debris.

Clearly, such situations are not desirable and a need exists for an apparatus capable of limiting or remedying one or more of these situations.

DRAWINGS

The following descriptions are provided for reference and are not intended to limit the disclosure to only the embodiments shown.

DETAILED DESCRIPTION

Figure 1:
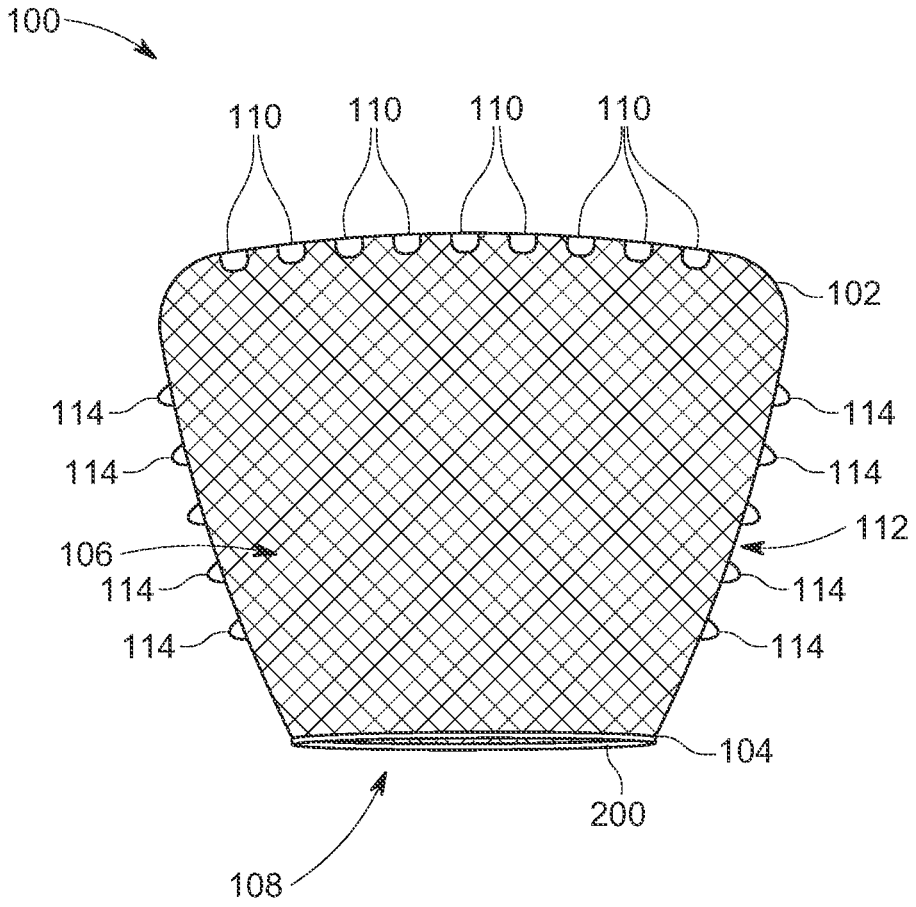
FIG. 1 illustrates a top side of an apparatus having a top end with a plurality of apertures and a bottom side in an embodiment of the present disclosure.

Characteristics and advantages of the present disclosure and additional features and benefits will be readily apparent to those skilled in the art upon consideration of the following detailed description of exemplary embodiments and/or referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of this disclosure and the appended claims. Many changes may be made to the particular embodiments and details disclosed herein without departing from such spirit and scope.

In showing and describing embodiments of the present disclosure in the appended figures, common or similar elements are referenced with like or identical reference numerals or are apparent from the figures and/or the description herein. The figures are not necessarily to scale, and certain features and certain views of the figures may be shown exaggerated in scale or in schematic in the interest of clarity and conciseness.

As used herein and throughout various portions (and headings) of this patent (including the claims), the terms "invention", "disclosure", "present invention", "present disclosure", and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

Certain terms are used herein and in the appended claims to refer to particular components. As one skilled in the art will appreciate, different persons may refer to a component by different names. Also, the terms "including" and "comprising" are used herein and in the appended claims in an open-ended fashion, and thus should be interpreted to mean "including, but not limited to . . . ". Further, reference herein and in the appended claims to components, feature, actions, aspects, etc. in a singular tense does not limit the present disclosure or appended claims to only one such component feature, action, aspect, etc., but should be interpreted to mean one or more, except and only to the extent as may be expressly limited otherwise herein or in a particular claim hereof and only for such claim(s) and any claim(s) depending therefrom.

FIG. 1 illustrate an apparatus 100 in an embodiment of the present disclosure. The apparatus 100 may generally be referred to as a cover 100. The cover 100 may have a top end 102 and a bottom end 104 opposite the top end 102. The top end 102 can have a size substantially similar to the size of a desired container, such as but not limited to a glass, bottle, or decanter. The top end 102 can be slightly larger in size than the size of the desired glass or container. The bottom end 104 may be smaller in size than the top end 102 to prevent the top end 102 from moving in at least one direction with respect to the desired glass or container as will be further described.

Between the top end 102 and the bottom end 104 is an interior 106 of the cover 100. The interior 106 may be sized and shaped as desired by the user of the cover 100. For example, the interior 106 can be configured to have a shape substantially similar to a wine glass, a decanter, a bottle or other device in which the user may apply the cover 100. An opening 108 may be adjacent the bottom end 104 and provide access to the interior 106.

The top end 102 of the cover 100 can be constructed of various materials within the spirit of the present disclosure. Various fabrics, including but not limited to polyester and nylon, or other materials, such as but not limited to plastic or composite may be used to form the top end 102. The top end 102 of the cover permits air to flow through the top end 102 and into the interior 106. The top end 102 may be constructed in various manners to permit such air to flow into the interior 106. For example, the top end 102 may have apertures 110 formed therein permitting the air to flow through the top end 102 into the interior 106. The apertures 110 can be incorporated or inherent in the material, such as a knit or polyester material that has holes or gaps in between the material. The apertures 110 can be formed into the material, by molding in the case of a plastic, composite or other type of material requiring such apertures for air flow. The apertures 110 are configured to permit air flow while preventing flying insects to pass through. While the present disclosure anticipates various sizes of apertures and is not meant to limit the apertures 110 to any specific size, the apertures 110 may be less than 2 mm in size.

Between the top end 102 and the bottom end 104, a body 112 of the cover 100 may have a generally tapered shape such that the body 112 adjacent the top end 102 is larger in size than the size of the body 112 adjacent the bottom end 104. The body 112 may be made of the same material as the top end 102 and the bottom end 104 or a different material and secured or attached thereto. The body 112 may have an uneven, discontinuous or contoured surface to aid in gripping and moving the body 112. As an example, the body 112 may have protrusions 114 positioned about the body 112. The protrusions 114 may be made of the same material as the body 112. As an example, the protrusions 114 may be constructed of rubber, silicone or other material capable of providing a texture to the surface of the body 112. In an embodiment, the protrusions 114 are positioned about a substantial portion of the body 112.

The bottom end of the cover 100 may have a securement mechanism 200. The securement mechanism 200 can be used to secure the cover 100 to a wine glass, wine bottle, wine decanter or other container. For example, the securement mechanism 200 may be configured to temporarily increase a size of opening 108 at the bottom end 104. In an embodiment, the securement mechanism 200 can change the size of the opening 108 from a first size to a second size, such as a first diameter to a second diameter. The securement mechanism 200 can increase the size of the opening 108 to a size substantially similar to the top end 102. The securement mechanism 200 can then bias the bottom end 104 back to a size less than the top end 102. Upon attachment of the cover 100 to a container, the securement mechanism 200 can bias, retract or otherwise cause the size of the opening 108 to be substantially similar to that of the container. The securement mechanism 200 can exert a force upon the container to create a snug fit of the cover 100 onto the container. While various materials are contemplated in the securement mechanism 200, as a mere example, elastic can be incorporated into the bottom end 104 to permit the size of the bottom end 104 to expand to a greater size and then resiliently retract to a small size.

Figure 2:
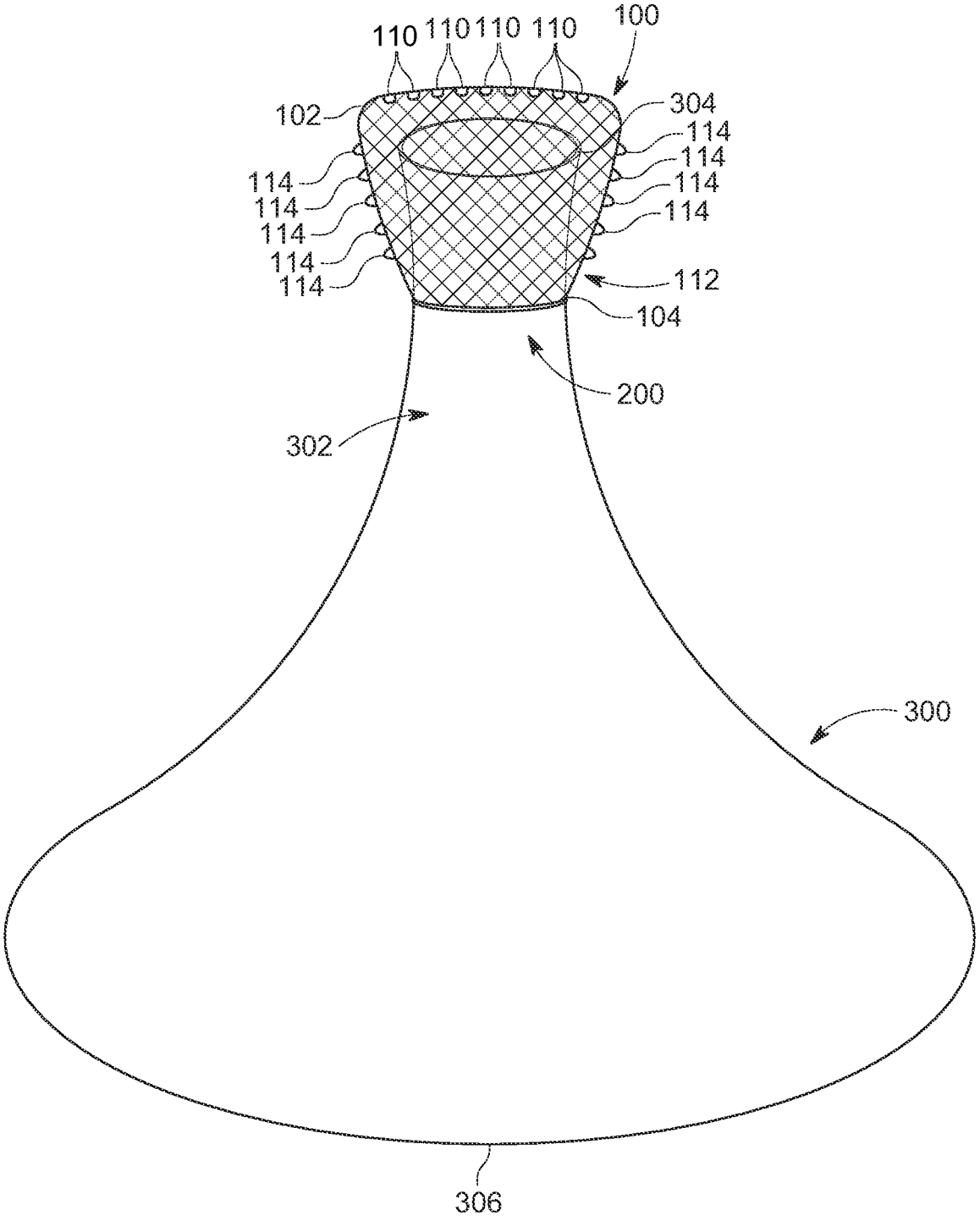
FIG. 2 illustrates an apparatus secured to a wine decanter in an embodiment of the present disclosure.

FIG. 2 illustrates an example of the cover 100 secured to a decanter 300 in an embodiment of the present disclosure. The decanter 300 generally has an elongated neck 302 extending between a top end 304 and a bottom end 306 of the decanter 300. In use, the bottom end 104 of the cover 100 can be expanded to a diameter greater than the diameter of the top end 304 and positioned over the top end 304 of the elongated neck 302. The bottom end 104 of the cover 100 can, via the securement mechanism 200, retract the bottom end 104 of the cover 100 to a size smaller than the top end 304 of the elongated neck 302 of the decanter 300. For example, the securement mechanism 200 can be moved or manipulated to increase the size of the opening 108 of the cover 100 to accommodate the size of the top end 304 of the decanter 300.

In FIG. 2, the bottom end 104 of the cover 100 is positioned against the elongated neck 302 of the decanter 300. Specifically, as shown, the bottom end 104 of the cover 100 may be positioned between the top end 304 and the bottom end 306 of the decanter 300. The elongated neck 302 may have a minimum diameter positioned between the top end 304 and the bottom end 306 in which the bottom end 104 of the cover 100 can be secured. As a result of the securement mechanism 200 biasing or retracting the bottom end 104, the cover 100 is prevented from moving toward the top end 304 of the elongated neck 302 of the decanter 300. In the embodiment of FIG. 2, the top end 102 of the cover 100 can be substantially similar to the diameter of the top end 304 of the elongated neck 302 of the decanter 300 to provide a sort of snug fit of the cover 100 to the decanter 300.

The apertures 110 can permit air to flow through the top end 102 of the cover 100 and into the decanter 300. For example, the cover 100 may be constructed of a breathable material, such as a mesh, having the apertures 110 formed therein. In another example, the apertures 110 can be formed into the top end 102 of the cover 100. The apertures 110 can extend continuously over the top end 102 of the cover to permit air to flow into the top end 304 of the decanter 300. The apertures 110 can be sized to prevent flying insects, debris and other items from moving through the cover 100 and into the decanter 300. The number, size and positioning of the apertures 110 can be changed or modified depending on the needs of the user and as will be appreciated by those having ordinary skill in the art.

The protrusions 114 can be positioned about the body 112 to provide a gripping or other textured surface to the cover 100. To remove the cover 100, a user may grip the protrusions 114 and/or engage the securement mechanism 200 to expand a size of the bottom end 104 of the cover 100. The size of the bottom end 104 may expand to a size larger than a dimension of the decanter 300, such as a size larger than the top end 304 of the elongated neck 302 of the decanter 300.

Figure 3:
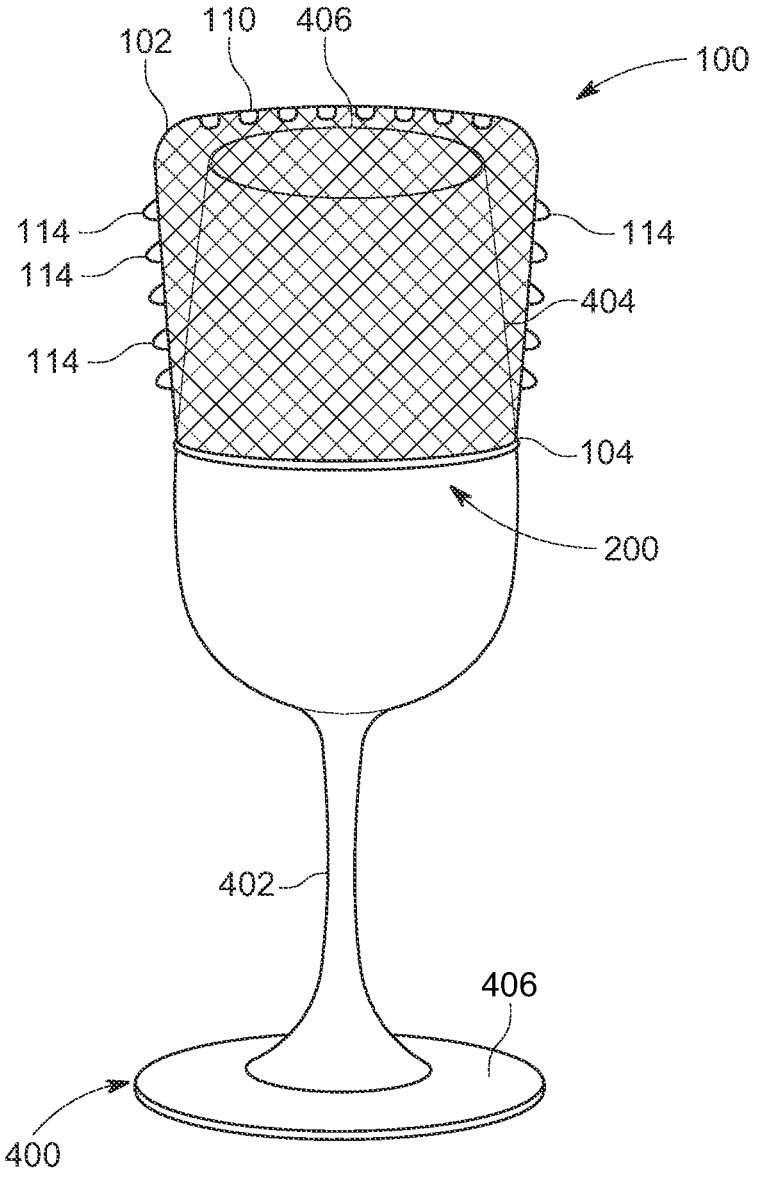
FIG. 3 illustrates an apparatus secured to a wine glass in an embodiment of the present disclosure.

FIG. 3 illustrates an embodiment of the cover 100 positioned on a wine glass 400. A stem 402 of the wine glass 400 may extend between a goblet 404 and an enlarged foot 406. The cover 100 can have its bottom end 104 expanded, such as by pulling or otherwise manipulating the securement mechanism 200. For example, the bottom end 102 may be expanded to a size substantially similar to a size of the top end 102 of the cover 100. The bottom end 104 can be positioned on the wine glass 400 and over the goblet 404. The bottom end 104 can be positioned adjacent the stem 402 of the wine glass 400. The securement mechanism 200 may bias or otherwise retract the size of the bottom end 104 to secure the cover 100 to the wine glass 400. For example, the bottom end 104 may retract to a size or diameter substantially similar to the diameter of the stem 402 of the wine glass 400. As another example, the bottom end 104 may expand or retract to a size of the goblet 404, such as a dimension between the stem 402 and a top surface 406 of the goblet 404. The cover 100 can be moved onto the wine glass 400 such that the top end 102 of the cover is adjacent a top surface 406 of the goblet 404. The top end 102 can be sized such that it is substantially similar to the size of the goblet 404 at the top surface 406.

The apertures 110 can permit air to flow into and out of the top end 102 of the cover 100 and into the wine glass 400. For example, the apertures 110 can be positioned only on the top end 102 and the remaining portion of the cover 100 may prevent or at least substantially prevent air from flowing therethrough. The apertures 110 can extend continuously over the top end 102 of the cover to permit air to flow into the wine glass 400. As another example, the material of the cover 100 may inherently provide the apertures 110 to permit airflow therethrough. For example, the cover 100 may be constructed of a breathable material having the apertures 110 formed therein. Air flowing into the wine glass 402 can allow wine contained therein to breath and unwind the tightness of the wine to permit more of the characteristics or flavors of the wine to be enjoyed by a user.

A user can engage the protrusions 114 about the body 112 to grip the cover 100. Engagement of the securement mechanism 200 may be done by a user pulling or tugging at a bottom end 104 to expand a size of the bottom end 104 of the cover 100. The size of the bottom end 104 may expand to a size larger than a dimension of the wine glass 400, such as a size larger than the top surface 406 of the wine glass 400, or otherwise the largest dimension of the goblet 404 of the wine glass 400.

Figure 4:
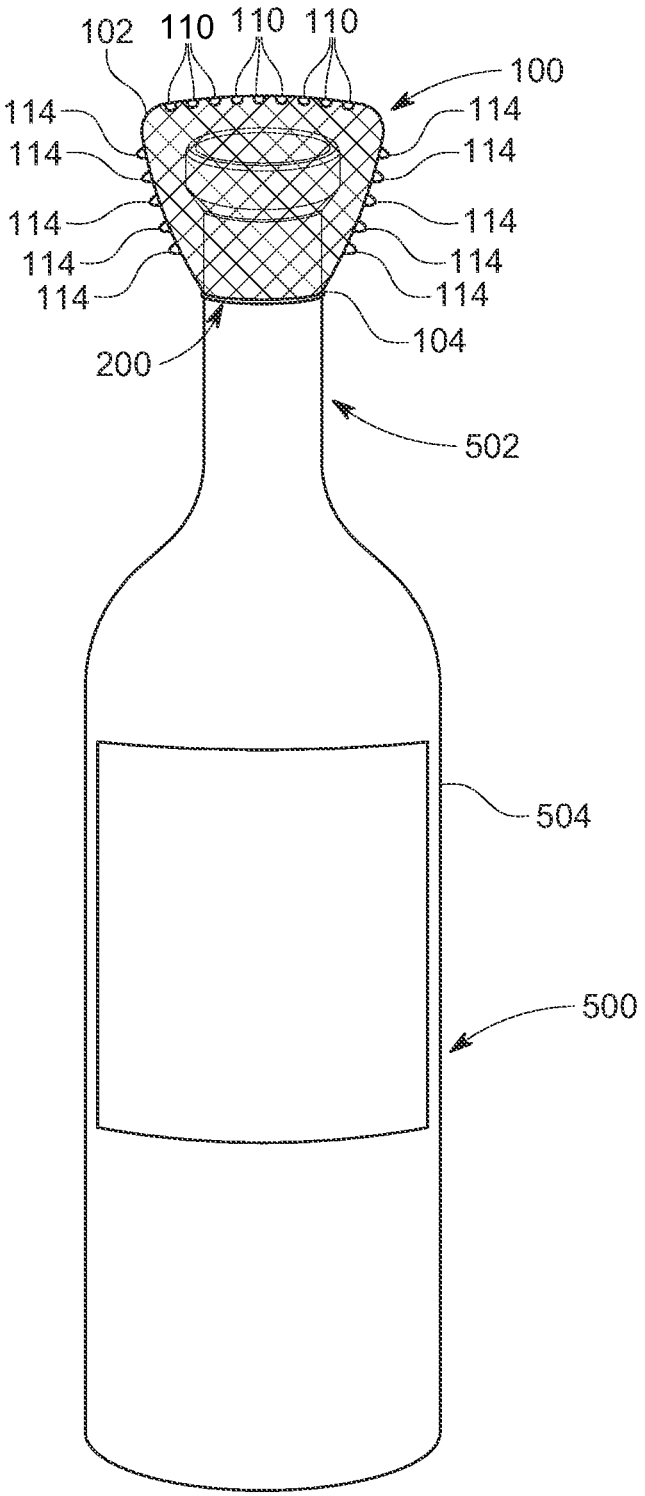
FIG. 4 illustrates an apparatus secured to a wine bottle in an embodiment of the present disclosure.

Turning to FIG. 4, a wine bottle 500 is illustrated having a lower, body portion 504 and an upper neck portion 502. The cover 100 is positioned about the top of the upper nexk portion 502 of the wine bottle 500. To do so, the bottom end 104 may have the securement mechanism 200 moved to a position such that the diameter of the bottom end 104 is larger than the diameter of the upper neck portion 502 of the wine bottle 500. The cover 100 can then be positioned over an opening in the upper neck portion 502. The securement mechanism 200 can be engaged to decrease the diameter or size of the bottom end 104 of the cover 100. In an embodiment, the bottom end 104 can be decreased in size to a size substantially similar to the size of the upper neck portion 502 of the wine bottle 500. In such an embodiment, the securement mechanism 200 can prevent upward or downward movement of the cover 100 with respect to the wine bottle 500.

The other features of the cover 100 described herein may optionally be included in the cover 100 as shown in FIG. 4. For example, as in other embodiments, the cover may optionally have the apertures 110 to permit air to flow into and out of the cover 100, and the protrusions 114 as described herein.

As used herein, the terms "about" and "substantially" are intended to include the degree of error associated with measurement of the particular quantity based upon the equipment available at the time of filing the application. For example, "about" may include a range of +10%, or 5%, or 2% of a given value or other percentage change as will be appreciated by those of skill in the art for the particular measurement and/or dimensions referred to herein.

The terminology used herein is for the purpose of describing particular embodiments only and is not intended to be limiting of the present disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an illustrative embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

The invention claimed is:

1. A cover comprising:

a top end having apertures therein permitting the flow of air through the top end;

a bottom end having an opening therein sized to receive a portion of a container therein; and a securement mechanism to removably secure the bottom end to the container, the securement mechanism permitting the bottom end to expand and retract to different sizes to receive and engage the container.

2. The cover of claim 1 wherein the top end is constructed of a breathable material.

3. The cover of claim 1 wherein the securement mechanism comprises elastic.

4. The cover of claim 1 wherein the securement mechanism can change a size of the opening from a first size to a second size, the first size being smaller than the second size.

5. The cover of claim 4 wherein the cover further comprises protrusions positioned about a body of the cover, the protrusions located between the top end and the bottom end, wherein the protrusions extend from the body of the cover to provide a gripping surface.

6. The cover of claim 5 wherein the protrusions are discontinuously positioned about the body of the cover.

7. The cover of claim 1 wherein the cover is tapered from the top end to a bottom end, the top end having a larger size than the bottom end.

8. The cover of claim 1 wherein the container is a wine bottle, wine glass or a decanter.

9. The cover of claim 8 wherein the top end of the cover is substantially similar in size as a top surface of the container.

10. The cover of claim 1 wherein the securement mechanism biases the bottom end of the cover against the container.

11. A cover comprising:

a body having a length defined between a top end and a bottom end, the body having a plurality of apertures positioned at the top end, the plurality of apertures permitting air to flow into an interior of the body;

an opening in the body positioned adjacent the bottom end of the body, the opening sized and shaped to receive a portion of a container therein; and a securement mechanism positioned adjacent to the opening, the securement mechanism engageable to change a size of the opening from a first size to a second size, wherein the second size is larger than the first size.

12. The cover of claim 11 wherein the container is a wine glass, a wine bottle or a wine decanter.

13. The cover of claim 12 wherein the top end of the body is substantially similar to a top surface of the container.

14. The cover of claim 13 wherein the second size is at least as large as the top surface of the container.

15. The cover of claim 14 wherein the securement mechanism is engagable to increase the size of the opening to accommodate a portion of the container such that the top end of the body is adjacent to a top surface of the container.

16. The cover of claim 15 wherein the securement mechanism retracts the opening to the first size to contact the container.

17. The cover of claim 16 wherein the top end is made of a breathable material and further wherein the plurality of apertures comprises holes in the breathable material.

18. The cover of claim 16 further comprising a plurality of protrusions positioned about the body and extending outwardly thereform, the plurality of protrusions providing a gripping surface for the body.

19. The cover of claim 18 wherein the plurality of protrusions are continuously positioned about the body between the top end and the bottom end.

20. The cover of claim 16 wherein the securement mechanism comprises an elastic that biases the opening to the first size.

* * * * *